US005161111A

United States Patent [19]

Oehler et al.

[11] Patent Number: 5,161,111

[45] Date of Patent: Nov. 3, 1992

[54] METHOD AND APPARATUS FOR REGULATING QUALITY PARAMETERS IN A YARN PRODUCTION LINE

[75] Inventors: Reinhard Oehler, Berg am Irchel; Urs Meyer, Niederglatt; Jurg Bischofberger, Raterschen, all of Switzerland

[73] Assignee: Maschinenfabrik Rieter AG, Winterthur, Switzerland

[21] Appl. No.: 558,617

[22] Filed: Jul. 26, 1990

[30] Foreign Application Priority Data

Jul. 26, 1989 [DE] Fed. Rep. of Germany ..... 3924779

[51] Int. Cl.[5] ..... G06F 15/46

[52] U.S. Cl. ..... 364/470; 57/264

[58] Field of Search ..... 364/470; 57/263, 264, 57/265; 19/90, 105; 28/185, 241, 248

[56] References Cited

U.S. PATENT DOCUMENTS

| | | | |
|---|---|---|---|
| 4,408,447 | 10/1983 | Sloupensky et al. | 57/263 |
| 4,535,511 | 8/1985 | Leifeld et al. | 19/105 |
| 4,843,808 | 7/1989 | Ruge et al. | 57/264 |
| 4,876,769 | 10/1989 | Schlepfer et al. | 19/105 |
| 4,918,914 | 4/1990 | Eaton | 57/264 |
| 5,046,013 | 9/1991 | Ueda et al. | 364/470 |

FOREIGN PATENT DOCUMENTS

| | | |
|---|---|---|
| 3146285 | 7/1983 | Fed. Rep. of Germany . |
| 3151697 | 8/1983 | Fed. Rep. of Germany . |
| 3244619 | 9/1984 | Fed. Rep. of Germany . |
| 3712654 | 9/1988 | Fed. Rep. of Germany . |
| 3740616 | 11/1988 | Fed. Rep. of Germany . |
| 258032 | 7/1984 | German Democratic Rep. . |
| 550260 | 7/1984 | Switzerland . |
| 2132382 | 7/1984 | United Kingdom . |

OTHER PUBLICATIONS

Automatisierungsmöglichkeiten in der Spinnerei, VDI--Tagung der Fachgruppe Textil und Bekleidung, Mar. 26-27, 1987 (Binder), pp. 1-27.

Bericht über den 8. Internationalen Kongress mit Ausstellung für Mess- und Automatisierungstechnik, Interkama 80, VDI-Z 123 (1981, Jan.) (Becker), pp. 15-21.

Kontinuierlich arbeitende Vorbereitungsanlage mit eigenem Mikroprozessorsteuerungs und Regelsystem, Melliand Textelberichte, Oct. 1983 (—), p. 710.

Kontinuierlich arbeitende Spinnereivorbereitungsanlage mit Mikroprozessorsteuerungs und Regelsystem, Textil Praxis Int'l., Sep. 1983 (—), pp. 916-917.

Mikroelektronik-heutige und zukünftige Einsatzgebiete in Spinnereibetrieben, Vortrage zum Reutlinger Kolloquium, Nov. 19, 1984, Melliand Textilberichte, Jun. 1985 (Zünd), pp. 401-407.

Prozesssteuerung Durch Automatische Prozessdatenerfassung, Reutlinger Kolloquium, Nov. 19-20, 1984 (Fahrni), pp. 1-13.

Spinnerei: Bilanz und Perspektiven, Technologie, Mikroelektronik, Transportautomation, ITMA 87, Textil Praxis Int'l., Jan. 1988 (Schloz), pp. 19-30.

Technische Datenerfassung-Stand der Technik und Möglichkeiten für die Textilindustrie, Textil Praxis Int'l., Aug. 1980 (Rehr), pp. 931-933.

*Primary Examiner*—Jerry Smith
*Assistant Examiner*—Jim Trammell
*Attorney, Agent, or Firm*—M. Lawrence Oliverio

[57] ABSTRACT

A method and an apparatus for operating a process line in a spinning mill comprising various regions, for example comprising at least the regions blow room, spinning preparation and spinning, with each region being put together from several textile machines which operate in series and/or in parallel and form a machine plane, and with the individual series connected textile machines producing different fiber structures, wherein raw fiber material which enters into the blow room is obtained as spun yarn at the output of the spinning mill, is characterized in that one measures at least one quality feature of the respectively produced fiber structure at at least some textile machines in each of the named regions and uses it to regulate the respective textile machine or an earlier textile machine of the same region; and in that correction values are formed from at least some of the quality features measured in the spinning preparation and spinning regions and are used to influence the operation of a textile machine of an earlier region.

29 Claims, 9 Drawing Sheets

Fig.5

| MEASUREMENT LOCATION | SENSOR | TYPE OF MEASUREMENT | ACCURACY |
|---|---|---|---|
| RAW MATERIAL | STAPLE | i | 5% |
| | MICRONAIRE | i | * |
| | FIBER STRENGTH | i | * |
| | IMPURITY CONTENT | i | * |
| | COLOUR | i | 5% |
| | DEGREE OF RIPENESS | i | – |
| COARSE CLEANING | IMPURITY CONTENT | k | * |
| | WASTE | k or i | 1% |
| FINE CLEANING | IMPURITY CONTENT | k | * |
| | WASTE | k or i | 1% |
| BLENDER | MIXTURE | k | 1% |
| CARD | STAPLE | k or i | * |
| | IMPURITY CONTENT | k or i | * |
| | FIBER STRENGTH | i | * |
| | WASTE | k | * |
| | SLIVER COUNT | k | <0.5% |
| | CV SLIVER | k | 1% |
| | SPECTROGRAM | k | 1% |
| | MICRONAIRE | k or i | 5% |
| | COLOUR | k or i | 5% |
| | NEPS | k or i | 5% |
| DRAW FRAME | STAPLE | k or i | * |
| | SLIVER COUNT | k | <0.5% |
| | CV SLIVER | k | 1% |
| | SPECTROGRAM | k or i | 1% |
| | COLOUR | k or i | 5% |
| COMBING MACHINE | STAPLE | k or i | * |
| | SLIVER COUNT | k | <0.5% |
| | CV SLIVER | k | 1% |
| | SPECTROGRAM BAND | k | 1% |
| | MICRONAIRE | k | * |
| | COMBED OUT WASTE FIBERS | k or i | 1% |

Fig.6

| MEASUREMENT LOCATION | SENSOR | TYPE OF MEASUREMENT | ACCURACY |
|---|---|---|---|
| FLYER | ROVING TENSION | k | * |
| | ROVING BREAKS | k | — |
| | ROVING COUNT | kori | * |
| | CV ROVING | kori | |
| RING SPINNING MACHINE | THREAD TENSION | k | <5% |
| | THREAD BREAKS | k | — |
| | YARN COUNT | iL | * |
| | CV | k | 1% |
| | IPI | k | * |
| | STRENGTH | iL | * |
| | ELONGATION | iL | * |
| | 4K(S,L,T,MO) | k | |
| | HAIRINESS | k | 3% |
| ROTOR SPINNING MACHINE | THREAD BREAKS | k | — |
| | YARN COUNT | kL | * |
| | CV | k | |
| | P | k | * |
| | STRENGTH | iL | * |
| | ELONGATION | iL | * |
| | 4K(S,L,T,MO) | k | |
| | SPECTROGRAM | k | |
| NEW TYPE SPINNING MACHINES, FOR EXAMPLE FRICTION, FALSE TWIST OR OTHER SPINNING MACHINES | THREAD BREAKS | k | — |
| | YARN COUNT | k | * |
| | SPECTROGRAM | kori | 1% |
| | CV | k | |
| | P | k | * |
| | STRENGTH | iL | * |
| | ELONGATION | iL | * |
| | 4K(S,L,T,MO) | k | |
| WINDER | 4K(S,L,T,MO) | k | |
| | CV | i | * |
| | YARN COUNT | kori | * |
| | SPECTROGRAM | i | 1% |
| | MIXTURE | i | * |
| | HAIRINESS | i | 3% |
| | SPRINGINESS | iL | * |
| | CLASSIMAT | i | |

L = LABORATORY MEASUREMENT

Fig.7

| LOCATION OF MANI-PULATION | CONTROLLED OR REGULATED PARAMETER | MANIPULATED VARIABLE |
|---|---|---|
| BALE OPENING | PRODUCTION<br>DEPTH OF OPENING | POSITION OF OPENING MEMBER |
| COARSE CLEANING | DEGREE OF CLEANING | GRID POSITION<br>GRID ADJUSTMENT<br>SPEED OF ROTATION<br>AND OTHERS |
| FINE CLEANING | PRODUCTION<br>DEGREE OF CLEANING | DELIVERY<br>POSITION OF CARDING PLATE<br>KNIFE ADJUSTMENT<br>AMONGST OTHERS |
| BLENDER (NATURAL + SYNTHETIC FIBERS) | PRODUCTION<br>MIXTURE | SPEED OF ROTATION<br>AT INLET<br>DELIVERY |
| BLENDER (NATURAL FIBERS) | PRODUCTION<br>MIXTURE | SPEED OF DELIVERY<br>OF COMPONENTS<br>DELIVERY |
| CARD FEEDING | PRODUCTION | SPEED OF<br>ROTATION OF<br>FEED ROLLER |
| CARD | PRODUCTION<br>SLIVER COUNT<br>WASTE<br>CV | SPEED OF DOFFER ROLL<br>TAKE IN SPEED<br>CHANGE CLOTHING<br>OR AGRESSIVENESS<br>OF CLOTHING<br>DRAFTING MECHANISM<br>(VARY DRAFTING MECHANISM<br>AT CARD OUTLET) |
| DRAW FRAME | PRODUCTION<br>SLIVER COUNT<br>CV | TAKE IN SPEED<br>RUN OUT SPEED<br>CLAMPING DISTANCE<br>DRAFTING MECHANISM |
| COMBING MACHINE | PRODUCTION<br>SLIVER COUNT<br>CV<br>SETTING DISTANCE<br>SPECTROGRAM<br>SLIVER | TAKE IN SPEED<br>(FEED AMOUNT)<br>NIP RATE<br>DISTANCE NIPPER<br>DETACHING ROLLER<br>CLAMPING DISTANCE<br>DRAFTING MECHANISM |

Fig. 8

| LOCATION OF MANI-PULATION | CONTROLLED OR REGULATED PARAMETER | MANIPULATED VARIABLE |
|---|---|---|
| FLYER | PRODUCTION<br>ROVING COUNT<br>TWIST | SLIVER ENTRY SPEED<br>DELIVERY<br>SPEED OF ROTATION OF SPINDLE<br>SPEED OF ROTATION OF FLYER ARMS |
| RING SPINNING MACHINE | PRODUCTION<br>YARN COUNT<br>TWIST<br>CV | FRONT CYLINDER SPEED<br>REAR CYLIDER SPEED<br>SPINDLE SPEED<br>DRAFTING MECHANISM DISTANCE |
| ROTOR SPINNING MACHINE | PRODUCTION<br>YARN COUNT<br>TWIST | SPEED OF FEED ROLL<br>SPEED OF TAKE OFFROLLS<br>ROTOR SPEED<br>SPEED OF WINDING ROLLERS |
| NEW TYPE OF SPINNING MACHINE | PRODUCTION<br>YARN COUNT<br>TWIST | SLIVER ENTRY SPEED<br>DRAFT<br>DELIVERY |
| WINDER | PRODUCTION | WINDING SPEED |

Fig. 9

| MACHINE | MEASURED VALUE | TYPE OF MEASURE-MENT | CONTROL INTERVENTION |
|---|---|---|---|
| WINDER | YARN FINENESS | i | DRAFT OF RING SPINNING MACHINE |
| | SPRINGINESS | i | SPINDLE SPEED OF RING |
| | MIXTURE | i | SPINNING MACHINE |
| | CV | i | ALARM |
| | CLASSIMAT | i | RING SPINNING DRAFTING MECHANISM |
| | HAIRINESS | i | ALARM |
| RING SPINNING MACHINE GUIDE SPINDLE+ ROTOR SPINNING MACHINE | THREAD TENSION | k | SPEED OF ROTATION |
| | YARN COUNT | i | DRAFT |
| | CV | k | DRAFTING MECHANISM |
| | IPI | k | COMBING MACHINE CARD |
| | STRENGTH | i | SPEED OF ROTATION |
| | ELONGATION | i | SPEED OF ROTATION |
| | THREAD BREAKS | k | SPEED OF ROTATION |
| | HAIRINESS | k | ALARM |
| FLYER GUIDE SPINDLE | ROVING TENSION | k | SPINDLE/FLYER ARM |
| | CV ROVING | | SPEED OF ROTATION |
| | ROVING BREAKS | k | SPINDLE SPEED OF ROTATION |
| | ROVING COUNT | | DRAFT |
| COMBING MACHINE | STAPLE | k | MIXTURE |
| | COMBED OUT | k | MIXTURE |
| | WASTE FIBERS | k | DRAFT OF DRAFTING MECHANISM |
| | SLIVER COUNT | k | DRAFTING MECHANISM |
| | CV SLIVER | k | CLAMPING DISTANCE |
| | SPECTROGRAM SLIVER | k or i | DRAFTING MECHANISM |
| DRAW FRAME | STAPLE | i | DRAFTING MECHANISM |
| | SLIVER COUNT | k | DRAFTING MECHANISM |
| | CV SLIVER | k | DRAFT |
| | COLOUR | k or i | DRAFTING MECHANISM |
| | SPECTROGRAM | k or i | STOP CONTROLLER BANDWIDTH |
| CARD | STAPLE | k or i | CARD ADJUSTMENT MIXTURE |
| | IMPURITY CONTENT | k or i | CARD ADJUSTMENT BLOW ROOM SETTING |
| | SLIVER COUNT | k | DRAFT OF CARD |
| | CV SLIVER | k | DRAFT BETWEEN CARD AND COILER |
| | MICRONAIRE, COLOUR, NEPS | k or i | MIXTURE |
| BLOW ROOM | IMPURITY CONTENT | k | SETTING |
| | WASTE | | SETTING |
| RAW MATERIAL | STAPLE | i | MIXTURE |
| | MICRONAIRE | i | MIXTURE |
| | FIBER STRENGTH | i | MIXTURE |
| | IMPURITY CONTENT | i | BLOW ROOM SETTING |
| | COLOUR | i | MIXTURE |
| | DEGREE OF RIPENESS | i | MIXTURE |

METHOD AND APPARATUS FOR REGULATING QUALITY PARAMETERS IN A YARN PRODUCTION LINE

BACKGROUND

The present invention relates to a method of operating a production line of a spinning mill comprising various regions, for example comprising at least the regions blow room, spinning preparation and spinning, with each region being put together from several textile machines which operate in series and/or in parallel and form a machine plane, and with the individual series connected textile machines producing different fiber structures, wherein raw fiber material which enters into the blow room is obtained as spun yarn at the output of the spinning mill.

Such production or process lines in spinning mills are customary in the manufacture of yarn. The building of a chain consisting of a series of different textile machines in which each machine further processes the product of the preceding machine leads to an extensive mutual dependency of the machines, and indeed not only with respect to the speed of production but also with respect to the characteristics of the respectively produced products.

Various individual proposals can be found in patent literature as to how one can determine a specific quality feature at the output of various machines and control the operation of the machine so that the monitored quality feature lies in a specific range of desired values. A problem with these previous proposals is however the fact that, as a rule, they only relate to individual machines or combinations of machines and ignore the influence on other machines which are linked with them, as well as ignoring the overall effect on the rate of production.

SUMMARY OF THE INVENTION

The object of the present invention is to so develop a method of the initially named kind, or an apparatus for carrying out the method, that relevant quality features can be measured at all critical regions of a process line in a spinning mill, with the regulation of the entire process line being effected in such a way that, on the one hand, the speed of production with the individual interlinked textile machines can be maintained as far as possible in the sense of realizing a preset production plan and, on the other hand, in such a way that predeterminable quality features ca be at least substantially maintained in all critical areas of the method, so that the end product of the process line also largely satisfies the initially placed requirements from the point of view of quality. The process of the invention should preferably take place using computers which are connected together, and indeed in such a way that each computer can take clear decisions on the basis of the data presented to it, or can initiate an alarm when contradictory or non realizable set parameters are set or arise.

In order to satisfy this object provision is made, in accordance with the method, that one measures at least one quality feature of the respectively produced fiber structure at at least some textile machines in each of the named regions and uses it to regulate the respective textile machine or an earlier textile machine of the same region; and that correction values are formed from at least some of the quality features measured in the spinning preparation and spinning regions and are used to influence the operation of a textile machine of an earlier region.

With a method of this kind desired values or desired value ranges which may not be exceeded or fallen short of can be set for each textile machine, both for the quality features and also for the production speed of the respective machine. Should however the existing regulation system for the textile machine not be sufficient to regulate the quality features back into the desired ranges of desired values, then a correction can be effected at an earlier textile machine of the same region, or indeed in an earlier region of the process line of the spinning mill, without restricting the production rate of the textile machine. Such a restriction would not be desirable having regard to its overall effect on the economy of the manufacturing process. In other words the method of the invention offers the possibility of keeping the production speed at a desired maximum but of nevertheless maintaining the quality features and indeed through intentional changes in other regions of the manufacturing process, but naturally only in so far as the changes which are effected do not lead to impermissible deviations in other quality features or in the speed of production. In a case of this kind an alarm can be initiated and the company management can of its own accord consider other possible set parameters or eventually consider accepting a change of the production speed.

For these considerations the method of the invention delivers a quantity of data in the form of measured quality values which the company management can take into account with respect to the known relationships, optionally with the aid of a computer. The possibility of being able to effect a quality adjustment not only at the effected textile machine but rather also at an earlier machine and optionally also an earlier machine in another region, also provides an improved possibility for acting if a lack of quality is determined. If, for example, a shortening of the staple is found at the output of the card then one can first change the speed of rotation of the licker in roll so that the latter operates somewhat less aggressively.

If one then finds that shortening of the staple nevertheless occurs then one could look for the cause of the shortening of the staple that has occurred at an earlier fine cleaning machine which has been set too aggressively. One could thus already try out a new setting of the fine cleaning machine during the production of yarn in order to see whether in this way the measured staple can be changed back into the desired range again. If this succeeds without the impurity content of the cleaned or carded product moving out of the permissible ranges, which can be determined by corresponding sensors, then the new adjustment of the fine cleaning machine can be retained. If this does not succeed then one has to ask the question whether the problem of the staple being too short does not have its cause in the mixing ratios of the individual components of different origins which in known manner have different staples. Possibly the staple can be brought back into the desired range by effecting a change of the mixing ratios, with the effect of this change on the other measured parameters (for example on the color and the impurity content) being straightforwardly checkable through the monitoring of all these quality features.

In this example one is concerned exclusively with textile machines which lie in the blow room region. The invention however also enables quality corrections which go beyond the boundaries of a particular region. If, for example, it is found at the output of the ring spinning machine that the yarn strength is too low, with this lack of strength being attributable to a staple which is too short then the reason for the staple being too short could lie in the adjustment of the combing machine, for example if this were set too aggressively.

If one does not succeed in increasing the strength so that it lies in the desired range through a correction of the setting of the combing machine, then a decision can be taken that a further correction is necessary and one can, for example, correct either the setting of the card and/or the mixture of the individual components of different origins. This is naturally only possible to the extent that the quality features measured at the preceding textile machines leave certain room for adjustments. If this is not the case then possibilities for effecting a correction are continually sought further back in the manufacturing sequence.

Through this stepwise investigation of whether a correction can take place through a directly preceding machine of the same region or whether one must take action further back in an earlier region one ensures, in accordance with the invention that the changes that are required lead to the smallest possible disturbance of the already running process. If one were to turn at once to a change of mixing components, for example on determining a lack of strength at the output of the ring spinning machine, then this would have the consequence that a whole series of other parameters would be changed whereby the regulating process would be made much more complicated, if not indeed impossible.

The process of the invention can in particular be carried out with the aid of computers. For this purpose provision is made, in accordance with the invention, that the production steps in the individual regions are specified by process computers associated with the respective regions, with these computers also being responsible for the formation of the said correction values, and with the individual process computers which form a process control plane being connected together; and that the transfer of the respective correction values from one region to another takes place via the respectively responsible process computer.

It should be understood that where the use of individual computers is discussed herein, such individual computers could comprise a physically single computer having internal processing, transmission and communication capability for receiving data from separate sensors, processing such data and communicating signals and information between separate processors and back to separate textile machines and regions.

The provision of a respective process control computer for each region of the process line of the spinning mill leads to an economical exploitation of the capacity of commercially available computers, leads however, on the other hand, also to a certain autonomy of the region which has favourable effects on the total flow of data which has to be managed. Through this construction the quantity of data which has to be interchanged between the individual process control computers with the other is kept in limits, which is of advantage for the overall process.

The process control computers in the process control plane are preferably connected to an operation control computer or factory control computer with which they can exchange data. The operation control computer represents a factory control plane which is superior to, i.e. set above the process control plane and the machine plane.

With the method of the invention it is sensible if the process control plane additionally has a process control computer for a raw material store region and/or a process computer for a spool store region, with the movements of the raw fiber material in the raw material store and/or of the finished spools in the spool store being determined by the respective process control computers.

In the operation control computer there are stored, amongst other things, particulars of the orders that are received (extent of order, type of yarn, delivery quantities, planned delivery dates, agreed prices, quality features of the desired yarn) and also particulars relating to the stock of raw materials of different origins or the expected deliveries of raw materials of different origins or the expected deliveries of raw materials of different origins. Particulars concerning the technical features of the fibers of the individual bales are also stored.

The operation control computer enables the company management to produce a favourable production plan, whereby the individual customer orders are to be worked off in the envisaged sequence, providing the stocks of raw material, the deliveries of raw material and the available capacity permit this.

On the assumption that the production plan has been fixed then work starts on the first order which is to be processed. For this the requisite basic data is communicated from the operational control computer to the individual process control computers which are connected together typically via a local network and these process control computers effect the requisite basic settings for taking into use, operating and stopping the individual textile machines. This is done partly on the basis of the basic data transmitted from the operational control computer and partly on the basis of data contained in their respective memories. The system can also be programmed as a type of self learning system, so that, in the case of repeated orders, the basic settings which have once been learned can be used again, optionally with small adaptations to take account of variations in the characteristics of the individual raw fiber materials. Correction measures which have been tested once and found to be useful can always be repeatedly re-used, when the same pattern of deviations is present.

In operation the process can take place in such a way that the quality features measured in each region are transferred to the respectively responsible process control computer and the latter then carries out a comparison of these quality features with specified values, for example values specified by the operation control computer. In the event of an unfavorable comparison, the process control computer then intervenes in the control of the respective region, in so far as a change of the measured quality features in the sense of a more favourable comparison is possible within the scope of the regulation taking account of the production rate which is envisaged. If this is not achievable, or is only achievable by an undesired change of the regulation of the production, then the process control computer computes a correction value from the measured quality features, with the correction value being used for a parameter change in the previous region.

The regulation (feedback control) of the individual textile machines, as a result of the quality features measured at the output of the respective machine, is frequently effected by an autonomously functioning regulator associated with the machine. It is however also possible to effect the regulation of the individual textile machines by the respectively associated process control computer, as a result of the quality features measured at the output of the respective machine. This is nowadays of increasing significance since one increasingly carries out regulating processes via a correspondingly programmed computer.

The control or regulation of the production of the individual textile machines is preferably effected by the respectively associated process control computer and the latter can take account of the parameters set for the production by the operational control computer and the statements communicated from the other process control computers relating to the particular speed of production. Basically the system aims at a constant speed of production which should be as high as possible. A certain buffer capacity is frequently present between individual textile machines. For example approximately eight cards could produce the card slivers for two draw frames which operate in parallel to one another, with the card sliver being deposited in cans from which it is taken at a later point in time for further processing by the draw frames, so that the buffer capacity is determined by the number and capacity of the cans (including those in store between the cards and the draw frames). In this case each draw frame continues to operate at the same speed for a certain amount of time even if one card or several cards must be taken out of operation for a short time as a result of a defect.

The lack of production of the cards or insufficient production of the cards need only be taken into account when an operating state is reached in which there threatens to be an insufficient supply of card sliver for the draw frame.

Although one endeavors to measure the quality features on-line when possible, difficulties exist in determining certain parameters on location in real time. The corresponding quality features can however be measured in the laboratory and the results of these laboratory measurements can likewise be taken into account in determining any eventually necessary correction values, if the results of the laboratory measurements are communicated to the respectively responsible process control computer. Further advantageous developments of the method of the invention and also advantageous pieces of apparatus for carrying out the method are set forth in the subordinate claims 10 to 28.

BRIEF DESCRIPTION OF THE DRAWINGS

The invention will be explained in more detail in the following with reference to an exemplary embodiment and to the drawings in which are shown.

DETAILED DESCRIPTION OF PREFERRED EMBODIMENTS

Figure 1:
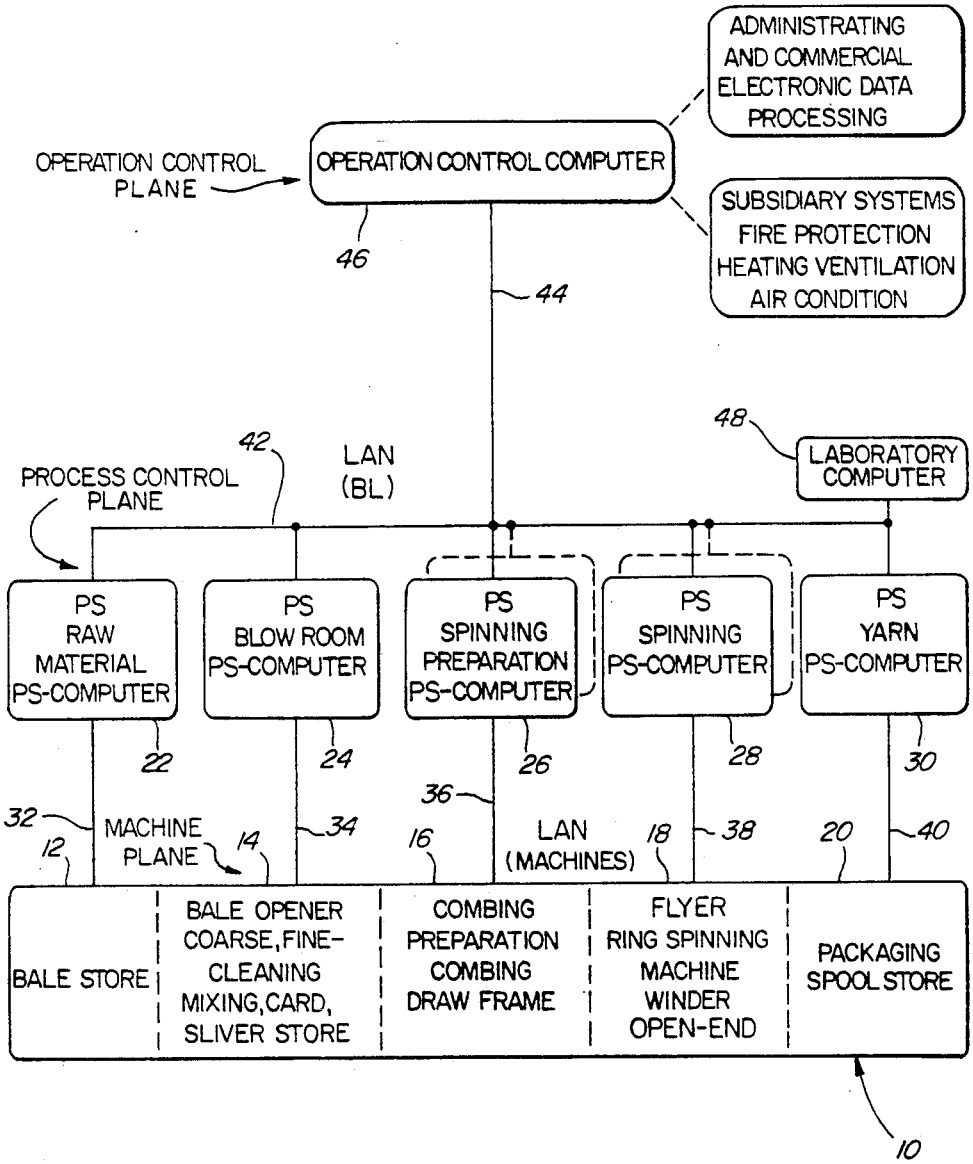
FIG. 1 a schematic diagram illustrating a hierarchy of individual computers (or processors), FIG. 2 a schematic diagram illustrating the cooperation between individual textile machines of the blow room region and for the schematic illustration of the measured quality features and the way and means in which these quality features are taken into account, FIG. 3 a diagram similar to that of FIG. 2 but for the process region "spinning preparation", FIG. 4 a further diagram similar to the diagram of FIG. 2, however in this case for the "spinning" region, FIG. 5 a table which gives an overview of the existing sensors in the regions "blow room" and "spinning preparation", FIG. 6 a table similar to the table of FIG. 5 but with particulars of the given sensors in the "spinning" region, FIG. 7 a table with particulars of typical control and regulating parameters and also typical set values in the regions "blow room" and "spinning preparation", FIG. 8 a further table similar to the table of FIG. 7 but for the "spinning" region, and FIG. 9 a tabular overview which shows quality features which are measured at individual textile machines and also control interventions which are primarily to be taken on deviations from these parameters, i.e. parameters which can be controlled when deviations from the desire values occur.

As seen in FIG. 1 a process line 10 of a spinning mill which represents a machine plane is subdivided into five regions 12, 14, 16, 18 and 20 arranged in series. The region 12 includes the bale store where the bales are stored and are transferred to the subsequent region, namely to the blow room region 14. The region 14 includes various textile machines, for example bale opening machines, coarse and fine cleaning machines, mixers and cards and also a sliver store. The region 14 is followed by the so called spinning preparation region 16 which in this example consists of combing machines and draw frames. Thereafter comes the spinning region 18 consisting of prespin machines, for example flyers, of ring spinning machines, of open end spinning machines and of other spinning machines, for example friction spinning machines and winders. The product of the region 18 consists of yarn spools and these are stored in a subsequent yarn spool store region 20 and are packaged in the packing section of the spool store for delivery to the respective customers.

It should be pointed out that the spinning region normally comprises either flyers and ring spinning machines, or open end spinning machines, or other spinning machines. A mixture of different types of spinning machines in this region is admittedly conceivable but rather improbable in practice.

A respective process control computer 22, 24, 26, 28, 30 is provided for each of the five named regions 12 to 20 and is connected via respective lines 32, 34, 36, 38 and 40 with the respectively associated product region 12 to 20. Between one another the process control computers 22 to 30 are interconnected via a local network which also includes a connection 44 to an operation control computer 46. Since the individual textile machines in the production line 10 of the spinning mill are at least partly equipped with their own computer controlled control and regulating systems the lines 32 to 40 could optionally also be connected into a local area network, so that communication is straightforwardly possible between each process computer and the associated computer controlled machines.

The five process control computers 22 to 30 define from the point of view of their hierarchy a process control plane while the operational control computer is one stage higher in the hierarchy and defines an operation control plane or factory control plane. In addition to the said computers a laboratory computer 48 can also be provided which is usefully integrated into the process control plane and which communicates with the process computers 22 to 30 via the local area network 42.

Since relatively little data is interchanged in the bale store region 12 and in the spool storage 20 the functions carried out by the raw material process control computer 22 and the yarn process control computer 30 can be integrated into the process control computer 24 for the blow and into the process control computer 28 for the spinning region respectively.

The production line 14 of the spinning mill, as shown here schematically, contains no transport systems.

When such transport systems are present then additional group computers for the transport systems can be connected to the local network 42. The orders of the individual customers together with all relevant particulars and also particulars concerning the fiber bales which have been bought by the company management and those which have yet to be delivered are fed into the operation control computer 46. The operation control computer also has access via the connection 44 and also the local network 42, to the data stored in the process control computer 22 regarding the present stocks of raw material and to the data in the process computer yarn 30 regarding the stocks of finished yarn which are stored, these pieces of data being necessary when the company management produces the individual production plans using the operation control computer. The operation control computer can also execute other necessary functions, for example it can manage administrative and commercial data processing tasks and control certain auxiliary systems such as fire protection and HLK systems.

Figure 2:
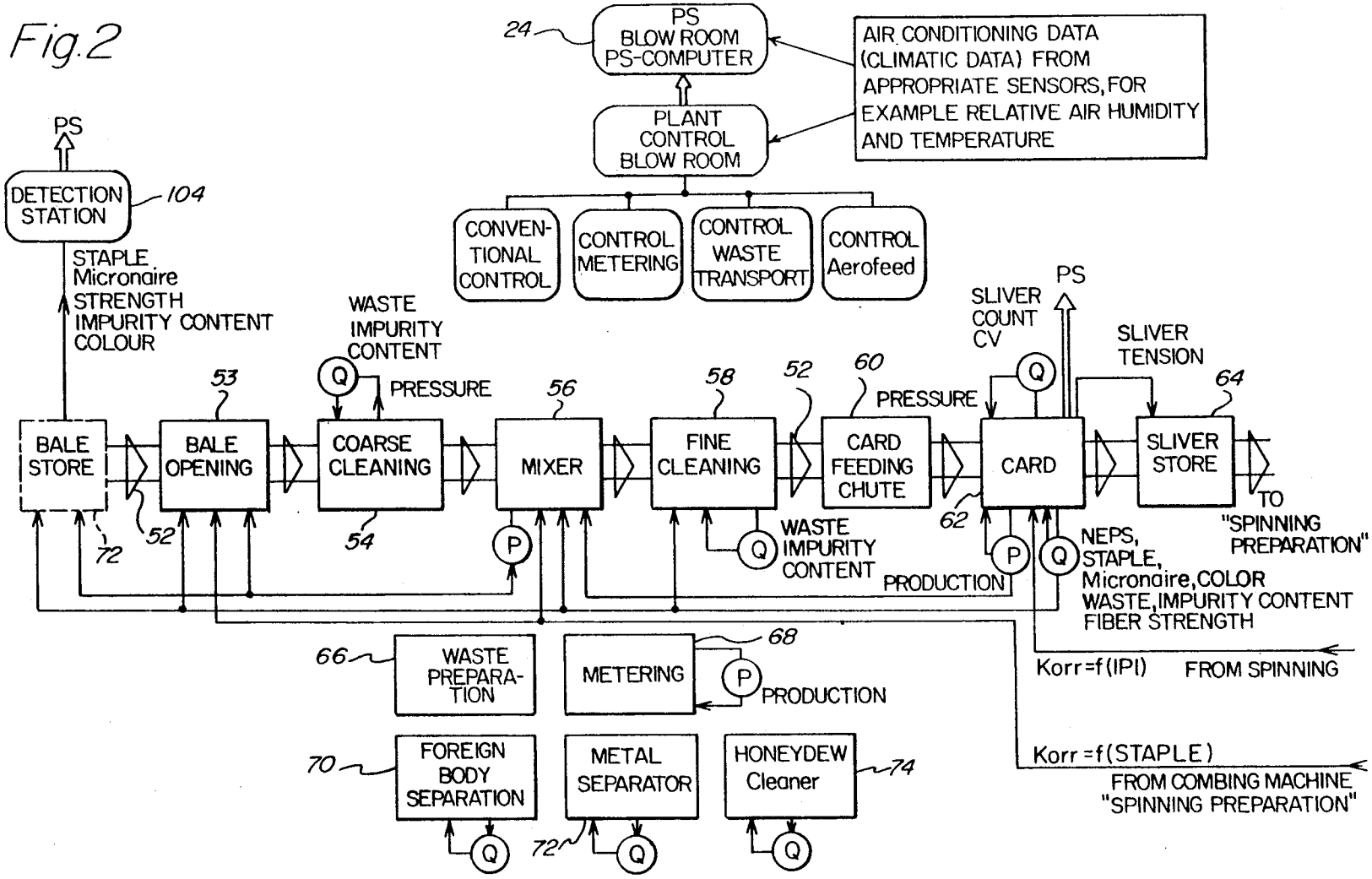
Figure 3:
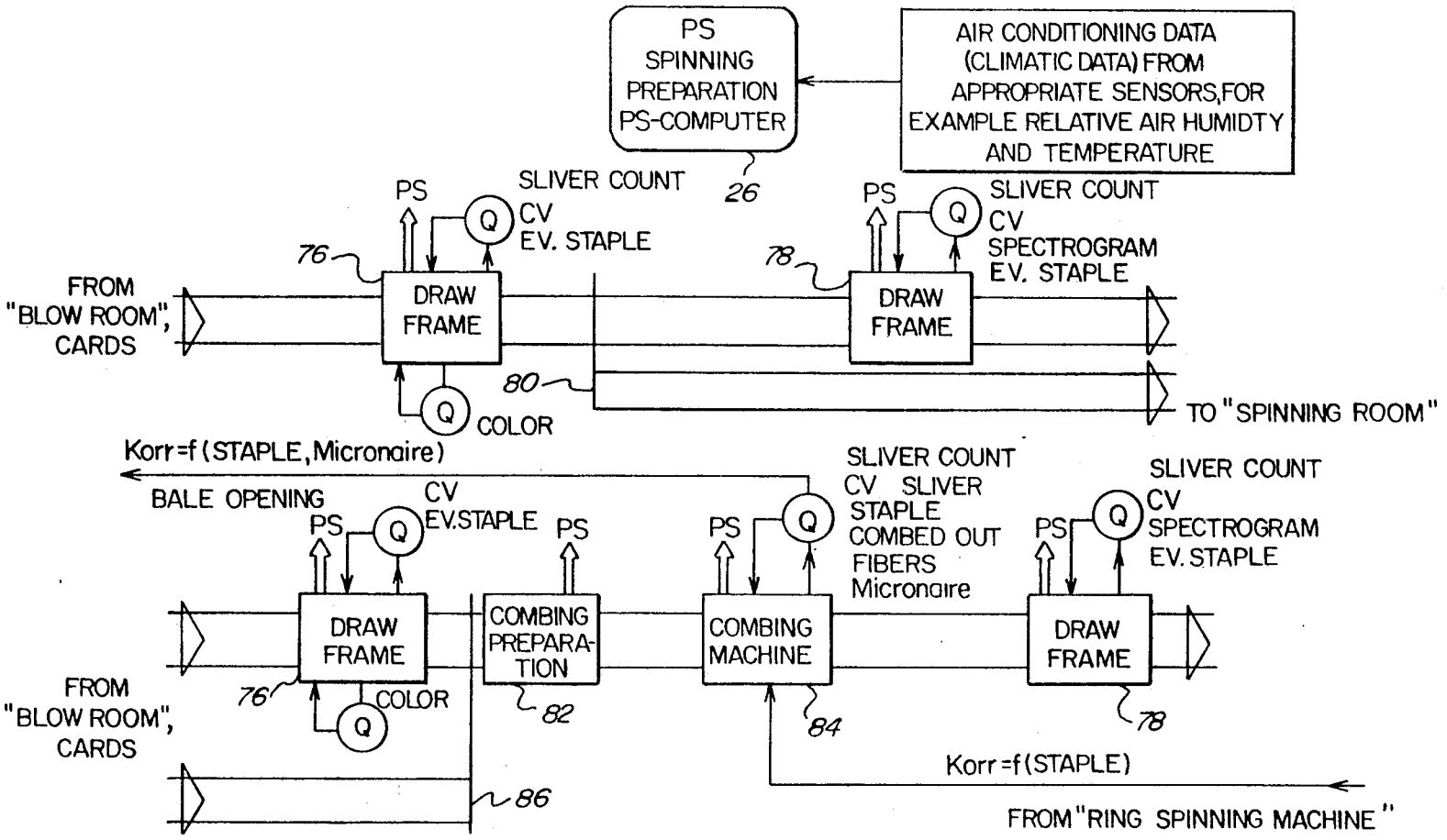
Figure 4:
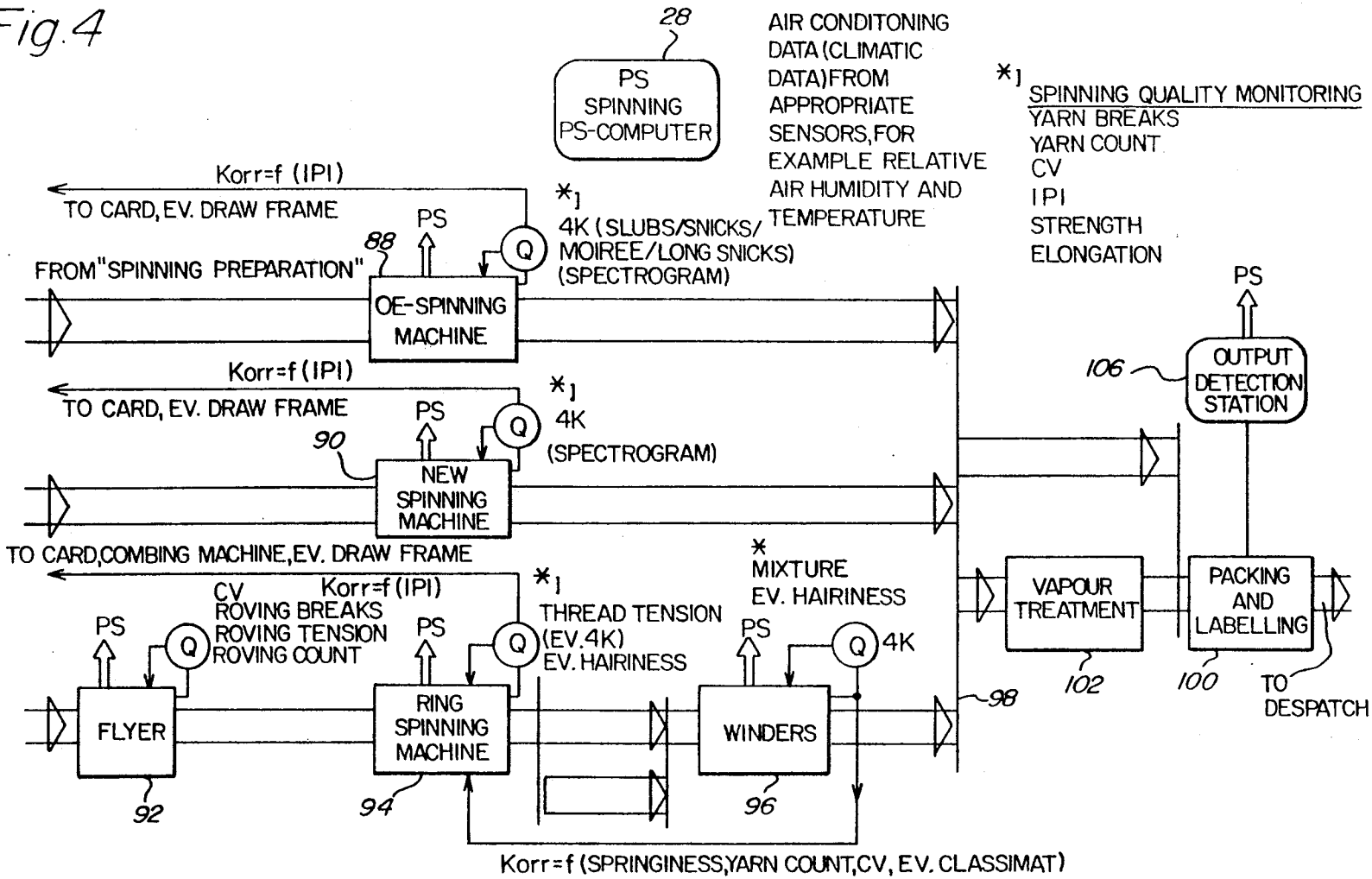

In order to better portray the cooperation of the computers with the individual regions reference is now made to FIGS. 2 to 4.

FIG. 2 shows the blow room region in continuous lines and the bale store region in broken lines. The material flow takes place in FIG. 2, from the left to the right and is characterized by arrow like triangles 52.

Bales from the bale store region 12 are first led to a bale opening machine 53 which removes fiber flocks from the individual bales and feeds them into a coarse cleaning machine 54. The coarse cleaned product then passes into a mixer 56 which mixes together the flocks of different origins which are received from the coarse cleaning machine 54. The proportions of the different components of different origins are determined in this example by the bale opening machine 54 and of course this bale opening machine can naturally only open those bales which are supplied to it from the bale store. The final product of the mixer then leads to a fine cleaning machine 58 and the finally cleaned flocks are then fed into the feed chute 60 of a card 62. Although only one chute 60 and one card 62 are shown in FIG. 2 in practice several chutes and cards are operated in parallel, i.e. are fed in parallel from the fine cleaning machine 58. The carded fibers are led together at the output of the card to a card sliver store and filled into cans which are temporarily stored in a sliver store 64. The cans then travel out of the sliver store 64 of the blow room into the spinning preparation region of FIG. 3.

Beneath the just described textile machine line there are shows a few further boxes in FIG. 2, the function of which will be briefly explained. The field 66 signifies a waste preparation machine, i.e. a machine which brings the fiber waste from other manufacturing stages back into flock form and the so prepared flocks can be mixed with the flocks coming from the bale opening machine 53 as mixing fibers. For this purpose the prepared flocks are supplied from the machine 66 to a metering machine 68 which then introduces the flocks into the pneumatic transport duct between the bale opening machine 53 and the coarse cleaning machine 54, which is however not shown here in order to simplify the representation.

Other machines or devices can be inserted between the bale opening machine and the coarse cleaning machine. These include for example a foreign body discharge device 70, a metal separation device 72 and a honeydew treatment device 74.

In FIG. 3 four different possibilities are shown for the further treatment of the card slivers delivered in cans from the blow room region.

The first possibility lies in further processing card slivers by doubling and drawings in two draw frames 76 and 78 connected in series in order to bring about an increase in sliver uniformity and a parellelization of the fibers. The line 80 indicates that it is not necessary to draw the card sliver twice, for some purposes it is sufficient to draw it once.

A third possibility exists in drawing the card slivers in a draw frame 76 and then preparing it for combing in a unit 82. Here, namely in the unit 82, several card slivers are placed together to form a coil and are then supplied to the actual combing machine 84. After the combing machine, the combed fleece is combined into a sliver and is again treated in a further draw frame 78. Finally, the vertical line 86 shows that the card sliver can be led directly to the combing preparation unit 82 bypassing the first draw frame 76.

The card sliver, in accordance with the upper part of FIG. 3, which has been treated twice by the draw frames 76, 78, is normally led to an open end spinning machine 88 which produces yarn therefrom.

The once drafted card sliver which is received at the vertical line 80 in FIG. 3 is in contrast more likely to be used for novel spinning processes such as for example friction spinning or nozzle spinning, with the corresponding process being carried out in the unit 90. In this case one also obtains a yarn as the direct product of the process.

The drafted and combed card sliver from the lower part of FIG. 3 is normally supplied to a flyer 92 and the roving which arises in this way is subsequently spun in a ring spinning machine 94 into the finished yarn. The yarn produced by the ring spinning machine and is wound onto spinning cops, is supplied to a winder 96 which cuts out faulty pieces of yarn and winds the yarn onto larger spools (cheeses).

The vertical line 98 signifies that a finished yarn product is also present here. The yarn product can be simultaneously packed up and labelled. This takes place with the machine 100, where the yarn is previously vapor treated in the vapor treatment unit 102. This applies to all yarns irrespective of whether they come from the open end spinning machine, from the ring spinning machine or from another spinning process.

The process control computers 24, 26 and 28 which are responsible for the respective regions are drawn in in FIGS. 2 to 5. The connections between the respective process control computers and the individual machines present in their respective regions are not shown in these figures. Instead a double line with the designation PS is simply used to indicate those machines at which quality features are measured and are communicated to the responsible process control computer, on the assumption, that the so measured quality features can also have an effect on another region. In FIG. 2 a detection station 104 is shown starting from the bale store and is likewise provided with a double line and the designation PS. In this case the responsible process control computer is either the process control computer 24 or a separate process control computer for the raw material region, in the event that a separate process control computer is provided for this region.

The same applies to the output detection station 106 of FIG. 4, i.e. the designation PS signifies here either the computer 28 associated with the spinning region or a separate region computer for the spool store, in so far as a computer of this kind is present for this region.

In many of the individual machines or units small circles can be seen with the designation "Q". In many cases an arrow leads back into the respectively associated machine/unit after the designation "Q". This "Q" signifies that quality features are measured and are used in the form of a regulation loop for the regulation of the corresponding machines. This can be an autonomously functioning regulating circuit (feedback control circuit) or the regulation can take place from the responsible computer for the region, depending on how the designer lays out the plant. For many units, for example at the card 62 quality controls, so-called Q controls, are provided which not only have an effect on the machine itself but rather also on the operation of a prior machine in the material flow direction. For example, in this respect the card is coupled back to the fine cleaning machine, to the bale opening machine and to the bale store.

The quality features which are measured are set forth adjacent each Q-control circuit. With many machines circles with "P" are also drawn in. These are devices for measuring the prevailing production speed and for regulating the actual production speed of the machine, and optionally also the production speed of earlier machines in the process line.

In order to make the individually measured quality features clearer the tables in FIGS. 5 and 6 show in a compact form which sensors are present at which machines. It is also stated in this table whether the quality features are intermittently detected (i) or continuously (k) and in some cases it is also emphasized that the monitoring can also eventually take place in either manner. The accuracy with which the individual sensors should preferably operate is also quoted alongside individual sensors. For sensors where the accuracy is indicated with double arrows it can be assumed that the sensors should preferably operate with an accuracy better than 1%.

A further aid in determining the control/regulating parameters which are encountered at the individual machines and the corresponding controlled variables are given by FIGS. 7 and 8. These are the control and regulating parameters of the machine internal regulating circuits, i.e. the regulating circuits which are associated with the respective machine. As a supplement to this the table of FIG. 9 also quotes those quality features which are detected at the machine and which can lead to control interventions at other machines.

Further particulars will now be explained with reference to FIGS. 2, 3 and 4.

From FIG. 2 one understands from the labelling adjacent the bale store 12 that certain quality features are determined for the individual bales of individual origins and indeed these are the staple, the Micronaire value, the fiber strength, the impurity content and the color. The corresponding values, which can optionally be stored in coded form on the bales are written into or read into the raw material region computer 22, or into the blow room region computer 24, and are also available there for the operation control computer. Bales of different origins are now presented to the bale opening machine 53 on the basis of the production plan set or specified by the operation control computer and the bale opening machine removes raw material from the individual bales in accordance with the desired mixing ratios. The so removed flock material is then subjected to coarse cleaning in a coarse cleaning machine. At the output of the coarse cleaning machine quality features are measured in the form of the impurities and fiber waste which is separated out. The pressure of the suction source integrated in the coarse cleaning machine is regulated in accordance with the measures values in order to keep the measured waste and impurity values within the desired limits. The measured values for waste and impurities are also communicated to the computer 24 for the blow room region. The coarse cleaned flocks are then supplied to the mixer 56 and mixed there before they are transferred to the fine cleaning machine 58.

The throughput of the mixer is detected and is used for the control of the working speed of the bale opening machine 53 and also eventually of the automatic bale transport systems in the bale store 12.

The mixed flocks subsequently run through the fine cleaning machine 58 and at the output of this machine quality features are measured in the form of the waste which arises the impurities which are separated out. If necessary, the adjustment of the fine cleaning machine is regulated via the regulation loop in order to keep the measured values for wastage and impurities within the desired limits. These values are communicated to the responsible process control computer 24.

After passing through the chute 60 the flock material is carded in the card 62. In the card the count of the card sliver, on the one hand, and also the CV value are measured and are used to regulate the card through an internal regulating loop. The corresponding values can also be transferred to the process control computer 24, so that the latter is fully informed of the process in the card. Since the card should also reach a certain level of production the production is also measured here and the operation of the mixer is correspondingly controlled and regulated, so that the mixer only mixes as many flocks as the card can actually process. Here the transport path within the fine cleaning machine and also the chute 60 naturally offer certain buffer capacities.

Internal regulating loops are also present at the foreign body separating unit 70, at the metal separating unit 72 and at the honeydew treatment unit 74 which determine the quality of the separation treatments which have taken place and regulates them to desired values. In the metering unit 68 the production is also regulated since one will ultimately only mix a fixed proportion of waste material with new material.

Furthermore, the number of neps, the staple, the Micronaire value, the color, the wastage, the separated out impurities and the fiber strength are measured at the output of the card and these values must satisfy quite specific criteria. If one does not succeed in keeping these values within the fixed limits through regulation of the card then an attempt is first made to improve the corresponding values by a new setting of the fine cleaning machine. If this does not succeed then it is necessary to effect a change of the mixing ratios, which must take place through the control of the bale opening machine, which is indicated by the arrow which lead into this machine. This finally also has affects on the bale store.

Although the corresponding arrows emerge from the corresponding Q-sensors of the card the signals are actually passed on further from the computer 24 for this region.

In all cases the computer 24 for this region continuously receives the values measured by the corresponding quality sensors and has the possibility of storing these values, at least temporarily. The card sliver which is produced is then filled into cans in tho sliver storage machine 64 with the operation of the can filling heads being regulated in such a way that a constant sliver tension is attained, which is brought out by the corresponding comment in FIG. 2 adjacent the can filling machine 64.

From FIG. 3 it is evident that internal control loops are provided at the draw frames 76 and 78 which maintain certain quality features within certain limits. One is concerned here with the count of the sliver that is produced, the CV value, the staple and also the color. The spectrogramm can also be measured and regulated. All the measured values are transferred to the responsible process control computer 26.

The combing preparation unit is also attached to the process computer 26, so that the computer always knows the operating state of this unit.

Furthermore, quality features in the form of the sliver count, the CV-value, the staple and the Micronaire value are also measured at the combing machine 84 of the spinning preparation region and are used for the internal regulation of the combing machine. These values are also transferred to the responsible process control computer 26.

If one does not succeed in maintaining the preset ranges for the appropriate quality features then corrections for the staple and for the Micronaire value must eventually be effected. This correction is effected by a new setting of the bale opening machine, i.e the mixing ratios of the individual components are changed. Although the corresponding arrow leads directly from the combing machine 84 to the bale opening machine 54, the necessity for the correction is actually recognized by the process computer 26 and is communicated via the local network 42 to the process computer 24 for the blow room region, and the corresponding change of the mixing ratios is effected by this computer, in accordance with the procedure for a correction as a result of discrepancies with the quality features at the output of the card 62.

At the output of the open end spinning machine the so called 4K value (statements concerning the frequency of slubs (thick portions)/snicks (thin portions), Moire values and long snicks (long thin portions)) and also the spectrogramm are measured and are regulated by an internal regulation circuit. If it is not possible to regulate these values into the desired ranges through the internal regulating circuit then a correction must effected at the card and eventually also at the draw frame, which is indicated by the corresponding arrows in FIGS. 2, 3 and 4.

In this case, the values measured in practice for the quality region and the latter decides over the need for a control intervention at the card or eventually at the draw frame. Once a decision has been taken on such a correction this is communicated to the responsible process computer 24 or 26 respectively and the corresponding new setting, or the corresponding control intervention, is executed by the responsible computer.

If one is concerned with a new spinning process instead of an open end spinning machine then precisely the same values are measured and regulated, which is evident from the corresponding comments in FIG. 4. Here the corresponding values for the quality features are communicated to the process control computer 28 for the spinning region which then effects the appropriate changes via the attached process control computers 24 and 26 respectively.

With the example of the flyer of FIG. 4 roving breakage status, roving tension values and the roving count are measured and internally regulated as quality features. The measured values are also communicated to the responsible process control computer 28 for the spinning region.

At a ring spinning machine quality features such as the thread tension, eventually the 4K-value and also eventually the hairiness are measured. If one does not succeed in gaining control of these values via an internal regulating circuit then a correction must be effected at the card, at the combing machine and eventually at the draw frame, which is indicated by the corresponding arrows in FIG. 4 and in FIGS. 2 and 3 respectively. The correction also takes place here with the aid of the relevant process control computer 28.

At the winding machine the 4K-value is again measured and used for the internal control of the manner of operation of the winding machine. After the winding machine one can also eventually check the fiber mixture and also possibly the hairiness of the yarn. One can also measure the stretch recovery, the yarn count, the CV value and eventually the Classimate value after the winder and exploit the measured value(s) to effect a correlation at the ring spinning machine 94. All these measured values are communicated to the process control computer 28, as indicated by the designation PS, and the possible correction measures at the ring spinning machine are instructed by the process control computer 28.

Should it turn out that the hairiness lies outside of the permissible limits then this is predominantly taken into account in such a way that alarm is triggered, so that one can investigate precisely where the cause of this hairiness lies.

Finally, all packaged and labelled spools are picked up in the output detection station 106 and the corresponding values are stored in the responsible process control computer and are available there to the operation control computer. These can consist of pure statements of quantity classified by yarn count and yarn characteristics, or can also be particulars of the respective storage locations. In the latter case, in so far as the spool store is computerized, for example in such a form that the transport systems and storage locations can be regulated or preset by the computer.

Finally, it should be emphasized that the subdivision of the machine into the given regions is regarded as particularly advantageous, but is not however absolutely essential. I.e. the boundaries between the individual regions could be selected somewhat differently from the subdivison described here.

That is to say that the "subdivision into three" of the process line of the spinning mill, i.e. into the three regions "blow room", "spinning preparation" and "spinning" (in a spinning room) is considered to be of particular importance.

The blow room is characterized by a continuous flow of material (pneumatic transport system) and terminates with the card.

The "spinning room" is characterized by a plurality of individual processing stations (spinning positions) and thus raises particular problems which require special solutions.

The "spinning preparation" region is characterized by a discontinuous flow of materials (in containers) and is strongly dependent on the end product (for example combed material/only carded material).

The identification of the spinning preparation region as a region for itself and its integration into the overall process line is considered particularly important for the present application.

It should be emphasized that the present invention is always based on the desired relationship between quality and rate of production. The following strategic possibilities exist:

1. to achieve constant quality (while allowing the production to vary),
2. to obtain ideal quality for a given rate of production and
3. to obtain maximum production for a given minimum quality.

These possibilities are expressed simply to clarify the fact that the present invention is not merely directed to obtaining a predetermined quality.

The present invention involves, as explained in detail above, the measuring of quality features and production rates at individual machines with the aim being basically to first try and effect a correction at the particular machine where the quality or production rates are measured, if the measured values do not correspond with the intended values. If this is not possible then an attempt is made to correct the measures values by correcting the performance of an earlier machine in the same region. If this is not possible then the correction is made at an earlier stage, i.e. at a machine in an earlier region of the production line.

These changes at an earlier machine of the same region, or at an earlier machine in an earlier region can indeed be made fully automatically with the present invention. This particularly applies to the regulation and correction of machines within the "blow room" region.

For practical purposes it is however entirely sufficient, and indeed desirable in order to increase user confidence, if each change which goes beyond the internal regulation of a single machine is first proposed by the computer system to the operator who can then execute a choice as to whether or not to accept the proposal using his own skill and Judgment. I.e. all corrections which appear to the computer to be necessary at an earlier machine of the same region, or at a machine in an earlier region are first suggested to the operator or management for approval prior to execution. If the operator or manager accepts the proposal then he can signify this to the computer system by a simple acceptance command and the computer system then proceeds to effect the correction at either the earlier machine of the same region or the relevant machine at in earlier region as the case may be. Thus the operator is given the chance to participate in the decision making process, with the proposal and the implementation of the proposal being dealt with automatically by the computer.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

What is claimed is:

1. A method of operating a production line of a spinning mill comprising selected fiber material processing regions, the regions comprising a blow room region, a spinning preparation region and a spinning region, each region comprising a plurality of textile machines each performing fiber processing steps and operating in series or in parallel to form a machine plane, the individual series connected textile machines producing different fiber structures, wherein raw fiber material which enters into the blow room is processed into spun yarn at the output of the spinning mill, the method comprising measuring at least one selected quality feature of the fiber structure produced by one or more of the textile machines in each of the selected regions, regulating at least one of the respective textile machine or an earlier textile machine of the same region on the basis of the measured quality feature, calculating correction values from at least one of the quality features measured in one or more of the spinning preparation and spinning regions, and using the correction values to modify the operation of a region preceding the region from which correction values were calculated.

2. Method in accordance with claim 1 wherein the processing steps performed in the individual regions are controlled automatically by process computers associated with each region, the process computers further automatically calculating the correction values, the individual process computers being connected together as a local area network to form a process control plane wherein the correction values are communicated automatically between the process computers to control operation of one region in accordance with correction values obtained from another region.

3. Method in accordance with claim 2 wherein the process computers in the process control plane exchange data including production and quality data with an operation control computer.

4. Method in accordance with claim 2 wherein the process control plane additionally has a process control computer for at least one of a raw material store region and a process computer for a spool store region, the movements of the raw fiber material in the raw material store and of the finished spools in the spool store being determined by the respective process control computers.

5. Method in accordance with claim 2 wherein the quality features measured in each region are supplied to the region's corresponding process control computer; each computer carrying out a comparison of the measured quality features with preselected values, and in the event of an unfavorable comparison intervenes in the control of the setting of an operating subassembly of a machine within the respective region, to effect a change of the measured quality features such that a more favourable comparison is achieved without changing the rate of production outside a preselected range of rates of production and computing a correction value for a quality feature for a machine in a previous region and inputting the correction value to the process control computer for the previous region when intervention in the control of the setting in the respective region effects a change in the rate of production outside the preselected range of rates of production.

6. Method in accordance with claim 2 wherein the regulation of the individual textile machines is effected as a result of the quality features measured at the output of this machine by an autonomously functioning regulator associated with this machine.

7. Method in accordance with claim 2 wherein the regulation of the individual textile machines is effected as a result of the quality features measured at the output of these machines by the respectively associated process control computer.

8. Method in accordance with claim 2 wherein the control and regulation of the production speed of the individual textile machines is also effected by the respective process control computer taking account of the production parameters preset by the operation control computer and the particulars communicated from the other process control computers concerning the respective speed o production.

9. Method in accordance with claim 2 wherein further quality features ar measured in a laboratory and the results of these laboratory measurements are likewise taken into account in determining any correction values which may eventually be necessary, with the results of the laboratory measurements being communicated to the respectively responsible process control computer.

10. Method in accordance with claim 2 wherein the following quality features are measured for the individual fibers of the raw material bales which are supplied during bale opening to the input to the blow room: staple, micronaire value, fiber strength, impurity content, color, degree of ripeness.

11. Method in accordance with claim 2 wherein the following quality features are measured at the output of a coarse cleaning machine belonging to the blow room region: impurity content, wastage, with both measurements of the quality features preferably being effected intermittently.

12. Method in accordance with claim 2 wherein one measures at least one of the quality features in accordance with the following table at the end of the winding machine in the spinning region, compares them with a desired value or with a desired value range and, in the case of an unfavorable comparison, effects the respectively associated control intervention:

| quality feature | control intervention |
|---|---|
| yarn count | draft of the ring spinning machine |
| stretch recovery (in German "Arbeitsvermögen) | spindle speed of the ring-spinning machine |
| CV | drafting mechanism of the ring-spinning machine |
| classimat value | drafting mechanism of the ring-spinning machine |

13. Method in accordance with claim 2 wherein in a spinning machine, at least one of the quality features in accordance with the following table are measured, are compared with a desired value or a desired value range and, in the event of an unfavorable comparison, the respectively associated control intervention is effected, with the measured values being obtained from fewer than all guide spindles of the spinning machine:

| quality feature | control intervention |
|---|---|
| thread tension | speed of rotation of spinning mechanism |
| yarn count | draft of drafting mechanism |
| CV | draft of drafting mechanism |
| strength | speed of rotation of spinning mechanism |
| elongation | speed of rotation of spinning mechanism |
| thread breaks | speed of rotation of spinning mechanism |

14. A method in accordance with claim 2 wherein in a flyer one measures at least one of the quality features in accordance with the following table, compares them with a desired value or with a desired value range and, in the event of an unfavorable comparison, effects the respectively associated control intervention:

| quality features | control intervention |
|---|---|
| roving tension | speed of rotation of spindles/speed of rotation of flyers |
| CV roving | speed of rotation of spindles/speed of rotation of flyers |
| roving brakes | speed of rotation of spindles |
| roving count | draft of drafting mechanism |

15. Method in accordance with claim 2 wherein in a combing machine at least one of the quality features of the following table are measured, are compared with a desired value or with a desired value range and, in the event of an unfavorable comparison, the respectively associated control intervention is effected:

| quality feature | control intervention |
|---|---|
| staple (waste) | composition of mixture |
| sliver count | draft of drafting mechanism |
| CV sliver | draft of drafting mechanism |

16. Method in accordance with claim 2 wherein in a draw frame at least one of the quality features in accordance with the following table are measured, are compared with a desired value or with a desired value range and, in the event of an unfavorable comparison the respectively associated control intervention is effected:

| quality feature | control intervention |
|---|---|
| staple | draft of drafting mechanism |
| sliver count | draft of drafting mechanism |
| CV sliver | draft of drafting mechanism |

17. Method in accordance with claim 2 wherein at least one of the quality features of the following table are measured, are compared with a desired value or with a desired value range and, in the event of an unfavorable comparison, the respectively associated control intervention is effected:

| quality feature | control intervention |
|---|---|
| staple | adjustment of the card<br>composition of mixture |
| impurity content | adjustment of the card<br>adjustment of the blow room |
| sliver count | draft of drafting mechanism |
| Mic. color, neps | composition of mixture |

18. Method in accordance with claim 2 wherein in a fine cleaning machine at least one of the quality features in accordance with the following table are measured, are compared with a desired value or with a desired value range and, in the event of an unfavorable comparison, the respectively associated control intervention is effected:

| quality feature | control intervention |
|---|---|
| impurity content | adjustment of the position of the carding plate<br>adjustment of the position of the knife |
| wastage | adjustment of the operating speed of rotation |

19. Method in accordance with claim 2 wherein in a coarse cleaning machine at least one of the quality features in accordance with the following table are measured, are compared with a desired value or a range of desired values and, in the event of an unfavorable comparison, the respectively associated control intervention is effected:

| quality feature | control intervention |
|---|---|
| impurity content | adjustment of the grid position<br>adjustment of the operational speed of rotation |
| wastage | adjustment of the grid position<br>adjustment of the operational speed of rotation |

20. Method in accordance with claim 2 wherein in a mixer at least one of the quality features of the following table are measured, are compared with a desired value or with a desired value range and, in the event of an unfavorable comparison, the respectively associated control intervention is effected:

| quality feature | control intervention |
|---|---|
| staple | change the composition of mixture |
| Micronaire | change the composition of mixture |
| fiber strength | change the composition of mixture |
| impurity content | change the composition of mixture |
| color | change the composition of mixture |
| degree of ripeness | change the composition of mixture |

with the change of the mixing ratios in the mixer also being taken into account during bale opening and/or in the bale store.

21. Method in accordance with claim 2 wherein the quality feature IPI is determined at the output of a ring spinning machine and, in the event that the value found lies outside of the permissible range, that a correction of at least one of the card or the combing machine or of the draw frame is effected.

22. Method in accordance with claim 2 wherein the quality feature IPI is determined at the output of an open end spinning machine, and if the value found lies outside of the permissible range, that a correction of at least one of the card or of the draw frame or, with combed rotor yarns, a correction of the combing section is effected.

23. Method in accordance with claim 2 wherein the quality feature IPI is determined at the output of a spinning machine which operates in accordance with a novel spinning process and, if the value found lies outside of the permissible range, that a correction of at least one of the card or of the draw frame is effected.

24. Method in accordance with claim 2 wherein the quality features, stable value and Micronaire value at the output of a combing machine are determined and, if the value found lies outside of the permissible range, that a correction of the staple and Micronaire values is effected by a change of the mixture of raw materials, with this change being taken into account during bale opening and at the mixer and also eventually in the bale store.

25. Apparatus for carrying out the method of claim 2 wherein measuring sensors for quality features and for the production speed are present at least one of the individual textile machines of the regions blow room, spinning preparation and spinning; the sensors being connected to respective process control computers associated with the regions; the process control computers being connected to at least one of the desired value inputs of the regulators associated with the respective machines associated with the process computers, or with positioning members of the machines respectively associated with the process control computers, the process control computers being connected together via a local network.

26. Apparatus in accordance with claim 25 wherein the process control computers are connected to an operational control computer via at least one of a bus or a local network.

27. Apparatus in accordance with claim 25 wherein further process computers are provided for at least one of the bale store or for the spool store.

28. Apparatus in accordance with claim 25 wherein tasks in the area of the bale store and of the spool store are carried out by the process control computers associated with the blow room region and the spinning region respectively, and in that data from the bale store and from the spool store are stored by the process control computers associated with the blow room region and the spinning region respectively.

29. Apparatus for automatically controlling and adjusting the production and quality of spun yarn in a spinning mill comprising successive fiber processing regions including a blow room region, a spinning preparation region and a spinning region, each region comprising one or more successive fiber processing machines operating to produce processed fiber in series, and each successive region operating in series such that fiber processed by one machine is prepared for input to an immediately successive to achieve a spun yarn output from the mill having preselected qualities and at a preselected rate of output, the apparatus comprising:

a process control computer corresponding to each region for regulating the operation of each machine within a corresponding region according to preselected regulation parameters;

a fiber quality measuring sensor associated with one or more machines of each region, each sensor measuring a preselected quality of the fiber output of a corresponding machine;

each of the sensors being connected to a process control computer corresponding the the region in which the sensor is measuring a fiber quality, the sensors inputting quality measurement signals to a corresponding process control computer;

the process control computers including means for comparing the quality measurements being input by the sensor to preselected fiber quality values;

an operation control means connected to the process control computers, the process control computers inputting comparison quality information to the operation control means, the operation control means including means for adjusting the regulation parameters of the process control computers according to a predetermined algorithm;

the algorithm prescribing predetermined relationships between regulation parameters to be carried out by each process control computer.

* * * * *